US009512655B2

(12) United States Patent
Kuo

(10) Patent No.: US 9,512,655 B2
(45) Date of Patent: Dec. 6, 2016

(54) HINGE STRUCTURE

(71) Applicant: Acer Incorporated, New Taipei (TW)

(72) Inventor: Yan-Lin Kuo, New Taipei (TW)

(73) Assignee: Acer Incorporated, New Taipei (TW)

( * ) Notice: Subject to any disclaimer, the term of this patent is extended or adjusted under 35 U.S.C. 154(b) by 14 days.

(21) Appl. No.: 14/735,157

(22) Filed: Jun. 10, 2015

(65) Prior Publication Data

US 2016/0083989 A1 Mar. 24, 2016

(30) Foreign Application Priority Data

Sep. 18, 2014 (TW) ..... 103132247 A

(51) Int. Cl.

| | |
|---|---|
| ***E05D 11/04*** | (2006.01) |
| ***E05D 11/06*** | (2006.01) |
| ***E05D 1/04*** | (2006.01) |
| *E05D 11/10* | (2006.01) |

(52) U.S. Cl.

CPC ..... *E05D 11/06* (2013.01); *E05D 1/04* (2013.01); *E05D 11/1028* (2013.01); *E05D 2001/045* (2013.01); *E05Y 2900/606* (2013.01)

(58) Field of Classification Search

CPC ... E05D 1/04; E05D 2001/045; E05D 11/10; E05D 11/1028; E05D 11/1042; E05D 11/105; E05D 11/1064; E05D 2011/1035; Y10T 16/54035; Y10T 16/54038; Y10T 16/5404; Y10T 16/54044; Y10T 16/54048

See application file for complete search history.

(56) References Cited

U.S. PATENT DOCUMENTS

| | | | | | |
|---|---|---|---|---|---|
| 375,394 | A * | 12/1887 | Strachan | E05D 1/04 | 16/355 |
| 457,824 | A * | 8/1891 | Curtis | E05D 1/04 | 16/355 |
| 2,056,805 | A * | 10/1936 | Reichard | E05D 1/04 | 16/355 |
| 2,233,882 | A * | 3/1941 | Bobek | E05C 17/38 | 16/348 |
| 2,770,834 | A * | 11/1956 | Jannace | E05D 1/04 | 16/250 |
| 3,521,319 | A * | 7/1970 | Julian | D06F 58/04 | 126/194 |
| 4,787,121 | A * | 11/1988 | Racenis | D06F 39/14 | 16/356 |
| 5,107,401 | A * | 4/1992 | Youn | G06F 1/1616 | 16/357 |
| 5,946,774 | A * | 9/1999 | Ramsey | E05D 1/04 | 16/355 |
| 6,292,981 | B1 * | 9/2001 | Ford | E05D 1/04 | 16/357 |
| 7,192,105 | B2 * | 3/2007 | Jung | E05D 11/1064 | 312/405 |
| 7,306,075 | B2 * | 12/2007 | Winslow | E06C 1/18 | 16/357 |
| 8,108,971 | B2 * | 2/2012 | Florek | E05D 1/04 | 16/193 |

(Continued)

FOREIGN PATENT DOCUMENTS

| | | |
|---|---|---|
| TW | M478076 | 5/2014 |
| TW | 201427572 | 7/2014 |

*Primary Examiner* — Jeffrey O Brien

(74) *Attorney, Agent, or Firm* — Jianq Chyun IP Office

(57) ABSTRACT

A hinge structure including a fixing member, a rotating member and an extension member is provided. The rotating member is pivotally disposed on the fixing member, and the extension member is pivotally disposed on the rotating member, wherein the fixing member and the extension member are adapted to be fixed at two parts respectively. After the rotating member rotates relative to the fixing member along a rotating axial direction and the extension member rotates relative to the rotating member along the rotating axial direction, an included angle between the extension member and the fixing member presents an acute angle, so that the two parts are adapted to stand on a platform. The extension member and the fixing member are adapted to increase the included angle through an external force exerted towards the platform, until the included angle presents 180 degrees and the two parts construct a plane.

7 Claims, 4 Drawing Sheets

(56) References Cited

U.S. PATENT DOCUMENTS 8,118,274 B2 * 2/2012 McClure ..... A47B 23/042 248/455
8,243,432 B2 * 8/2012 Duan ..... H04M 1/04 248/188.8
8,248,791 B2 * 8/2012 Wang ..... F16M 11/10 248/188.8
8,267,368 B2 * 9/2012 Torii ..... F16M 13/00 248/188.8
8,403,288 B2 * 3/2013 Cheng ..... F16M 11/10 248/673
9,304,549 B2 * 4/2016 Siddiqui ..... E05D 7/00
9,317,072 B2 * 4/2016 Park ..... G06F 1/1681
9,382,736 B2 * 7/2016 Tejima ..... E05D 1/04
2010/0133414 A1 * 6/2010 Lee ..... F16M 13/00 248/686
2010/0142130 A1 * 6/2010 Wang ..... F16M 13/00 361/679.01
2010/0259876 A1 * 10/2010 Kim ..... F16M 11/10 361/679.01
2011/0025176 A1 * 2/2011 McClure ..... A47B 23/042 312/223.2
2014/0174960 A1 * 6/2014 Zhu ..... H04M 1/04 206/45.24
2014/0293534 A1 * 10/2014 Siddiqui ..... E05D 7/00 361/679.55
2015/0212553 A1 * 7/2015 Park ..... G06F 1/1681 361/679.27

* cited by examiner

HINGE STRUCTURE

CROSS-REFERENCE TO RELATED APPLICATION

This application claims the priority benefit of Taiwan application Ser. No. 103132247, filed on Sep. 18, 2014. The entirety of the above-mentioned patent application is hereby incorporated by reference herein and made a part of this specification.

BACKGROUND

1. Technical Field

The invention relates to a hinge structure.

2. Related Art

In recent years, along with quick development of technology, electronic apparatuses such as notebooks (NBs), tablet personal computers (PCs), smart phones, etc. are frequently used in daily life. Types and functions of the electronic apparatuses become more and more diverse, and convenience and practicality thereof make the electronic apparatuses become more popular, and the electronic apparatuses may have different applications according to user's requirements. Regarding some of the electronic apparatuses with a flat shape, for example, a tablet PC, since a use angle of a device body thereof cannot be adjusted, the tablet PC can be used in collaboration with a supporting frame to facilitate adjusting the use angle, for example, to stand on the desktop.

For example, the commonly used supporting frame is constructed by a protection cover configured on the electronic apparatus, where the protection cover is substantially composed of two flat plates and a hinge structure, and the two flat plates can rotate relative to each other through the hinge structure. In this way, when the protection cover is disposed on a back surface of the electronic apparatus, the two flat plates construct a plane, such that the use of the electronic apparatus is not affected, for example, a hand feeling of the user holding the electronic apparatus is not affected, or placing of the electronic apparatus on the desktop is not affected. When the user wants to erect the electronic apparatus on the desktop, the lower plate of the protection cover can be opened relative to the electronic apparatus to serve as a supporting frame. In other words, the lower plate of the protection cover can be opened to serve as the supporting frame, and the electronic apparatus presents a tilt state while taking a bottom thereof and the supporting frame as supporting points. However, when the user operates the electronic apparatus, for example, the user presses a screen of the electronic apparatus, an external force exerted by the user is transmitted to the hinge structure on the protection cover, and the lower plate serving as the supporting frame departs from the bottom of the electronic apparatus and is bended towards the upper plate. Now, the hinge structure is easy to be damaged. In other words, the operations performed to the electronic apparatus are liable to cause damage of the hinge structure. Moreover, when the lower plate serving as the supporting frame is not used, the user has to retrieve the lower plate to the back surface of the electronic apparatus, which increases operation complexity of the electronic apparatus.

SUMMARY

The invention is directed to a hinge structure, which is adapted to connect two parts and expand in a fan-shape, so as to achieve a good operation mode.

The invention provides a hinge structure adapted to connect two parts, wherein the two parts are adapted to rotate relative to each other through the hinge structure. The hinge structure includes a fixing member, a rotating member and an extension member. The fixing member is adapted to be fixed at one of the two parts. The rotating member is pivotally disposed on the fixing member. The extension member is pivotally disposed on the rotating member, and is adapted to be fixed at another one of the two parts. After the rotating member rotates relative to the fixing member along a rotating axial direction and the extension member rotates relative to the rotating member along the rotating axial direction, an included angle between the extension member and the fixing member presents an acute angle, so that the two parts are adapted to stand on a platform. The extension member and the fixing member are adapted to increase the included angle therebetween through an external force exerted towards the platform, until the included angle presents 180 degrees and the two parts construct a plane.

According to the above description, in the hinge structure of the invention, the rotating member is pivotally disposed on the fixing member, and the extension member is pivotally disposed on the rotating member, where after the rotating member rotates relative to the fixing member along the rotating axial direction and the extension member rotates relative to the rotating member along the rotating axial direction, the included angle between the extension member and the fixing member presents an acute angle. In this way, when the fixing member and the extension member are respectively fixed at the two parts, the two parts are adapted to rotate relative to each other through the hinge structure to stand on a platform. Thereafter, even if the extension member and the fixing member take an external force, the included angle therebetween is only increased until presenting 180 degrees, so that the hinge structure is not damaged when taking the external force, and the rotated hinge structure can also be restored to an original state through the above method. Therefore, the hinge structure of the invention is adapted to connect two parts and presents a fan-shape expansion, so as to achieve a good operation mode.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
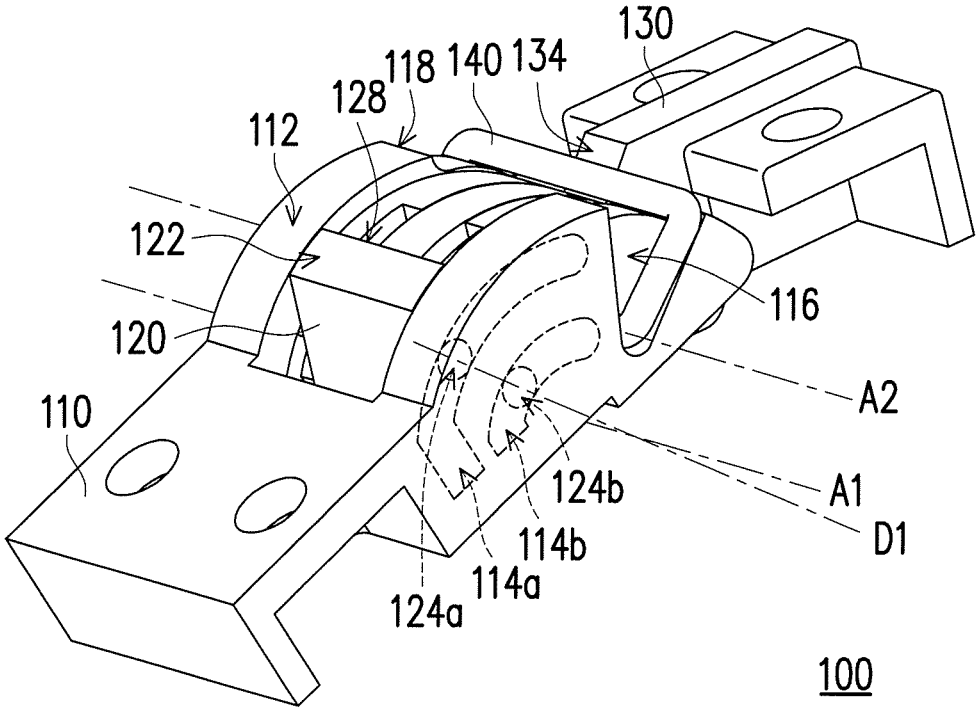
FIG. 1 is a three-dimensional view of a hinge structure according to an embodiment of the invention.
Figure 2A:
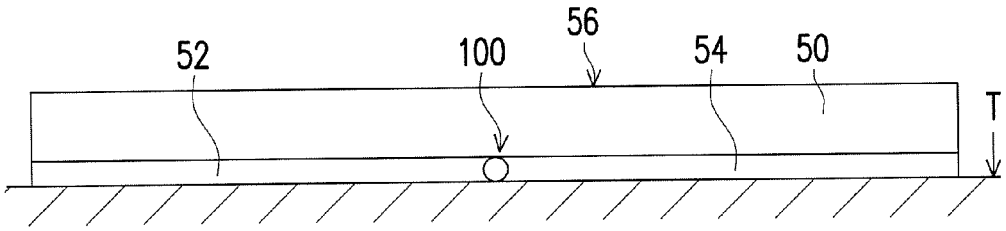
FIG. 2A and FIG. 2B are schematic diagrams of an electronic apparatus applying the hinge structure of FIG. 1.
Figure 2B:
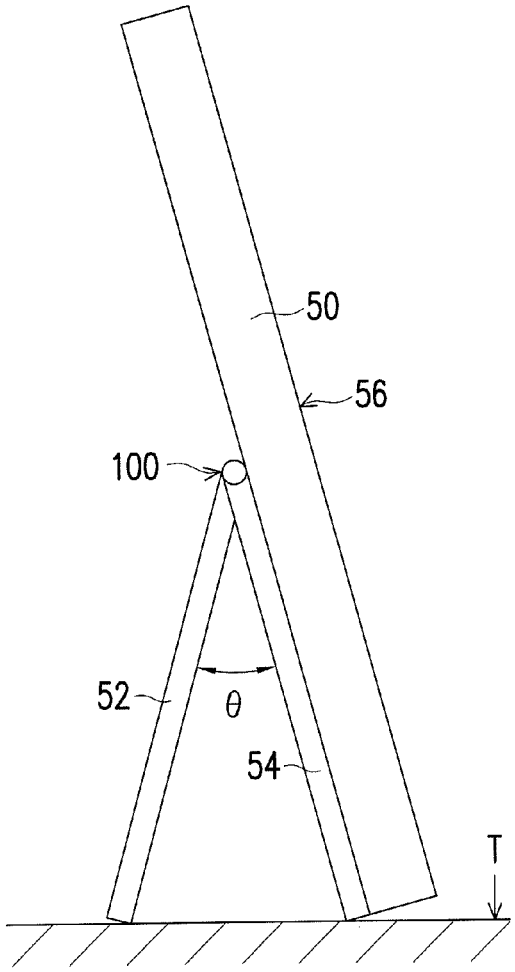

FIG. 1 is a three-dimensional view of a hinge structure according to an embodiment of the invention. FIG. 2A and FIG. 2B are schematic diagrams of an electronic apparatus applying the hinge structure of FIG. 1. Referring to FIG. 1 to FIG. 2B, in the present embodiment, the hinge structure 100 includes a fixing member 110, a rotating member 120 and an extension member 130. The rotating member 120 is pivotally disposed on the fixing member 110, and the extension member 130 is pivotally disposed on the rotating member 120. In this way, the rotating member 120 is adapted to rotate relative to the fixing member 110 along a rotating axial direction A1, and the extension member 130 is adapted to rotate relative to the rotating member 120 along the rotating axial direction A1. In other words, the fixing member 110, the rotating member 120 and the extension member 130 that are pivoted to each other are adapted to rotate relative to each other along the rotating axial direction A1 to presents a fan-shape expansion. Therefore, the hinge structure 100 in the present embodiment is adapted to connect two parts, and the two parts can rotate relative to each other through the hinge structure 100.

In detail, in the present embodiment, the two parts can be an upper plate 52 and a lower plate 54 (shown in FIG. 2A), where the fixing member 110 is adapted to be fixed at one of the two parts, for example, the lower plate 54, and the extension member 130 is adapted to be fixed at another one of the two parts, for example, the upper plate 52. In this way, the upper plate 52 and the lower plate 54 connected to the hinge structure 100 can serve as a supporting frame configured at a back surface of an electronic apparatus 50, where the electronic apparatus 50 is, for example, a tablet PC or a smart phone, though it can also be a notebook or other suitable electronic apparatus, which is not limited by the invention. When the fixing member 110, the rotating member 120 and the extension member 130 are not rotated relative to each other, the upper plate 52 and the lower plate 54 serving as the two parts construct a plane, such that the electronic apparatus 50 can be horizontally placed on a platform T (for example, a desktop), as shown in FIG. 2A. After the rotating member 120 rotates relative to the fixing member 110 along the rotating axial direction A1 and the extension member 130 rotates relative to the rotating member 120 along the rotating axial direction A1, an included angle θ between the extension member 130 and the fixing member 110 presents an acute angle, so that the upper plate 52 and the lower plate 54 serving as the two parts are adapted to stand on the platform T, as that shown in FIG. 2B. Further, the upper plate 52 is adapted to move towards the lower plate 54, such that the extension member 130 fixed on the upper plate 52 rotates relative to the rotating member 120, and the extension member 130 drives the rotating member 120 to rotate relative to the fixing member 110, so as to present the fan-shape expansion, and the upper plate 52 rotates downwards to approach the lower plate 54 until the included angle θ between the extension member 130 and the fixing member 110 presents an acute angle. In other words, the upper plate 52 and the extension member 130 rotates downwards to depart from the electronic apparatus 50 until the extension member 130 and the fixing member 110 include an acute angle, such that the upper plate 52 and the lower plate 54 can stand on the platform T. In this way, the electronic apparatus 50 presents a standing state, and an operation surface 56 thereof tilts relative to the platform T, so as to facilitate the user viewing or operating the operation surface 56 of the electronic apparatus 50.

Moreover, during a process of operating the electronic apparatus 50, for example, when the user presses the operation surface 56 by a finger, the electronic apparatus 50 receives an external force exerted towards the platform T, and the external force is transmitted to the hinge structure 100, the upper plate 52 and the lower plate 54. In this way, since the included angle θ between the extension member 130 and the fixing member 110 presents the acute angle, the extension member 130 and the fixing member 110 are adapted to increase the included angle θ therebetween through the external force exerted towards the platform T, until the included angle θ presents 180 degrees and the upper plate 52 and the lower plate 54 serving as the two parts reconstruct a plane. In other words, when the user presses the operation surface 56 by a finger during the process of operating the electronic apparatus 50, or when the user changes the stand state of the electronic apparatus 50 to an original state (suitable for laying on the platform T), in case that the external force exerted towards the platform T by the user is greater than frictions between the members of the hinge structure 100, the upper plate 52 and the lower plate 54 depart from each other to increase the included angle θ between the extension member 130 and the fixing member 110. When the user continuously exerts the external force, or when the exerted external force is relatively large, the included angle θ between the extension member 130 and the fixing member 110 is increased until the included angle θ between the extension member 130 and the fixing member 110 presents 180 degrees, and the upper plate 52 and the lower plate 54 standing on the platform T reconstruct a plane, wherein a process thereof is shown as FIG. 2B to FIG. 2A. Therefore, through the hinge structure 100 of the present embodiment, the two parts can rotate relative to each other to stand on the platform T, and when the hinge structure 100 receives an external force in case that the extension member 130 and the fixing member 130 include an acute angle, even if the external force is greater than the frictions between the internal members of the hinge structure 100 to make the extension member 130 and the fixing member 110 to rotate relative to each other and increase the included angle θ between the extension member 130 and the fixing member 110, the included angle θ is only increased to 180 degrees at most. In other words, when the hinge structure 100 receives the external force exerted towards the platform T, the extension member 130 and the fixing member 110 are gradually changed to the original state without interfering each other, so that the extension member 130 and the fixing member 110 are not damaged due to the external force. Therefore, the hinge structure 100 of the present embodiment is adapted to connect two parts and present a fan-shape expansion, and the rotated hinge structure 100 can also be restored to the original state according to the aforementioned method, so as to achieve a good operation mode.

Figure 3:
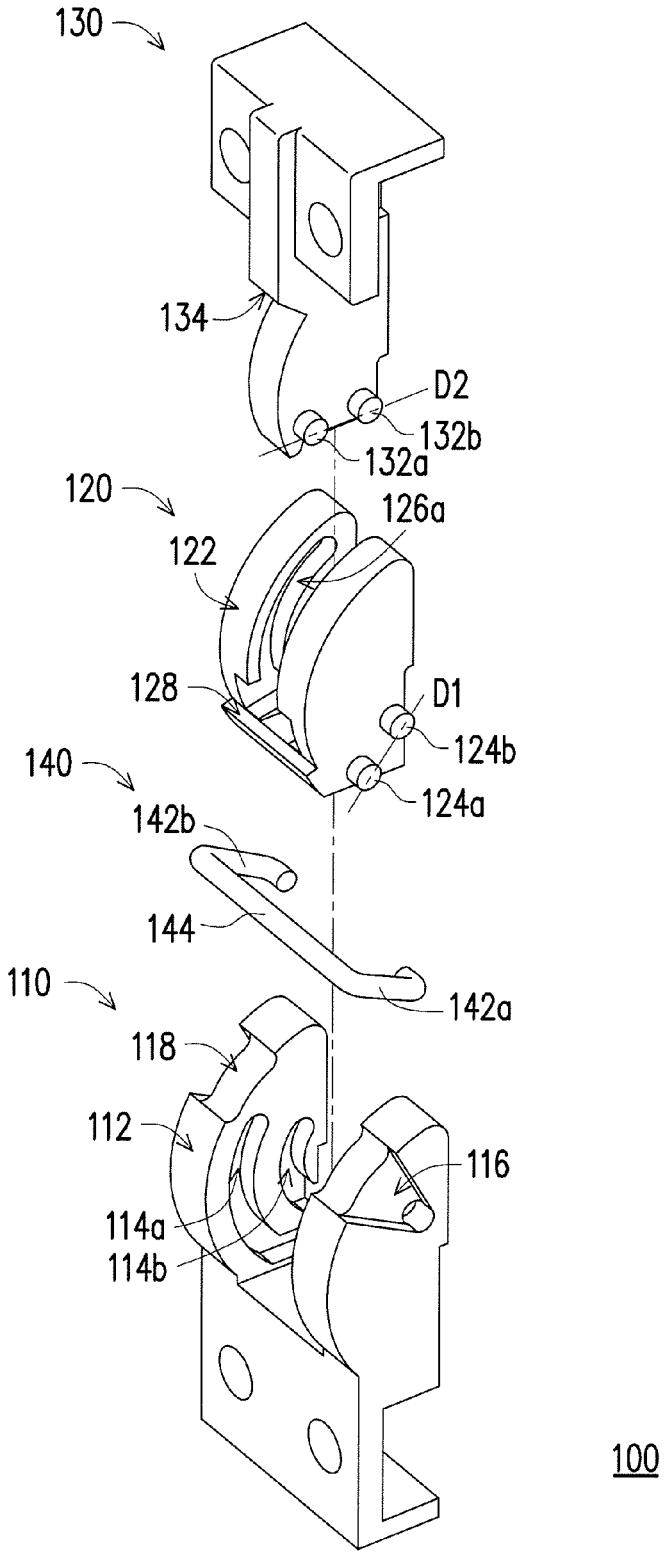
FIG. 3 is an exploded view of the hinge structure of FIG. 1.

FIG. 3 is an exploded view of the hinge structure of FIG. 1. Referring to FIG. 1 and FIG. 3, in the present embodiment, the fixing member 110 has a first connection portion 112. The rotating member 120 is pivotally disposed in the first connection portion 112. The rotating member 120 has a second connection portion 122, and the extension member 130 is pivotally disposed in the second connection portion 122. In this way, the first connection portion 112, the second connection portion 122 and the extension member 130 are overlapped to each other. Further, the first connection portion 112 and the second connection portion 122 of the present embodiment present a n-shape, so that the rotating member 120 can be pivotally disposed in the first connection portion 112 presenting the n-shape, and the extension member 130 can be pivotally disposed in the second connection portion 122 presenting the n-shape, such that the first connection portion 112, the second connection portion 122 and the extension member 130 are overlapped to each other.

Therefore, in the present embodiment, the hinge structure 100 further includes a clamping member 140, which clamps the first connection portion 112, the second connection portion 122 and the extension member 130 from outside inward, such that the fixing member 110, the rotating member 120 and the extension member 130 maintain fixed distances therebetween along a force-exerting axial direction A2 of the clamping member 140. In other words, since the first connection portion 112, the second connection portion 122 and the extension member 130 are overlapped to each other, when the fixing member 110, the rotating member 120 and the extension member 130 rotate relative to each other to presents the fan-shape expansion, the above members are probably loosed due to shaking. Therefore, in the present embodiment, the clamping member 140 is used to clamp the first connection portion 112, the second connection portion 122 and the extension member 130 from outside inward, such that the fixing member 110, the rotating member 120 and the extension member 130 maintain fixed distances therebetween along the force-exerting axial direction A2 of the clamping member 140, so as to avoid loosing due to relative movement.

Further, in the present embodiment, the clamping member 140 includes two force-exerting portions 142*a* and 142*b* and a stop portion 144 connected to the two force-exerting portions 142*a* and 142*b*. The two force-exerting portions 142*a* and 142*b* are opposite to each other for clamping the fixing member 110, the rotating member 120 and the extension member 130 from outside inward, and the stop portion 144 is located above the fixing member 110, the rotating member 120 and the extension member 130. In other words, the clamping member 140 substantially presents a n-shape, where the force-exerting portions 142*a* and 142*b* are opposite to each other, and clamp the fixing member 110, the rotating member 120 and the extension member 130 from outside inward along the force-exerting axial direction A2, and the stop portion 144 connected to the two force-exerting portions 142*a* and 142*b* is located above the fixing member 110, the rotating member 120 and the extension member 130. Moreover, the clamping member 140 preferably adopts an elastic material, for example, a metal elastic piece or an elastic clasp for stably clamping the fixing member 110, the rotating member 120 and the extension member 130. In this way, by using the clamping member 140, loose of the fixing member 110, the rotating member 120 and the extension member 130 is avoided. An outer surface of the fixing member 110 can be configured with positioning recesses 116, and the force-exerting portions 142*a* and 142*b* of the clamping member 140 are disposed in the positioning recesses 116. In this way, the clamping member 140 is position-limited in the positioning recesses 116, and is not easy to loose during a process that the fixing member 110, the rotating member 120 and the extension member 130 rotate relative to each other. Moreover, the force-exerting axial direction A2 is preferably parallel to the rotating axial direction A1, such that the fixing member 110, the rotating member 120 and the extension member 130 clamped by the clamping member 140 produce frictions therebetween when rotating relative to each other. Therefore, when the fixing member 110, the rotating member 120 and the extension member 130 rotate until the included angle θ (shown in FIG. 2B) presents an acute angle, the above members can fix a use angle (i.e. the included angle θ) of the hinge structure 100 through the frictions therebetween. When the external force exerted to the hinge structure 100 by the user overcomes the above friction, the aforementioned members can be rotated relative to each other to increase the included angle θ. Therefore, the clamping member 140 can be designed to increase the frictions to fix the use angle of the hinge structure 100.

Moreover, referring to FIG. 1 and FIG. 3, in the present embodiment, the fixing member 110 has two pairs of first curved slideways 114*a* and 114*b* respectively located at two opposite sides of the fixing member 110. In detail, an inner side of the first connection portion 112 presenting the n-shape in the fixing member 110 has the two pairs of the first curved slideways 114*a* and 114*b*, wherein one pair of the first curved slideways 114*a* and 114*b* located at one side takes the rotating axial direction A1 as an axial center, and the other pair of the first curved slideways 114*a* and 114*b* located at the other side also takes the rotating axial direction A1 as the axial center. In other words, the two pairs of first curved slideways 114*a* and 114*b* are symmetrically located at two opposite sides of the fixing member 110. Regarding one pair of the first curved slideways 114*a* and 114*b*, the two first slideways 114*a* and 114*b* are both arcs that take the rotating axial direction A1 as the axial center. In other words, trajectories of the two first slideways 114*a* and 114*b* can be regarded as partial arcs of two concentric circles with different radii that take the rotating axial direction A1 as a circle center, and expanded angles of the two curved slideways 114*a* and 114*b* relative to the axial center are the same. In this way, the rotating axial direction A1 of the present embodiment is not located on the fixing member 110 or the rotating member 120, but is a virtual axial direction located outside the fixing member 110 and the rotating member 120.

Correspondingly, an outer side of the rotating member 120 pivotally disposed in the first connection portion 112 has two pairs of first slide poles 124*a* and 124*b*, which are respectively located at two opposite sides of the rotating member 120. A connection direction D1 of one pair of the first slide poles 124*a* and 124*b* located at one side passes through the rotating axial direction A1, and the connection direction D1 of the other pair of the first slide poles 124*a* and 124*b* located at the other side also passes through the rotating axial direction A1. In other words, the two pairs of the first slide poles 124*a* and 124*b* are symmetrically disposed at two opposite sides of the rotating member 120. In this way, the two pairs of the first slide poles 124*a* and 124*b* can be correspondingly embedded in the two pairs of first curved slideways 114*a* and 114*b*, wherein the first slide poles 124*a* and 124*b* can slide along the first curved slideways 114*a* and 114*b* correspondingly, such that the rotating member 120 is adapted to rotate relative to the fixing member 110 along the rotating axial direction A1 while taking the rotating axial direction A1 as an axial center. Based on the design of the two pairs of first curved slideways 114*a* and 114*b* and the two pairs of first slide poles 124*a* and 124*b*, the rotating member 120 can rotate relative to the fixing member 110 along the virtual rotating axial direction A1.

Similarly, in the present embodiment, the rotating member 120 has two pairs of second curved slideways 126*a* respectively located at two opposite sides of the rotating member 120. In detail, the two pairs of the second curved slideways 126*a* are located at an inner side of the second connection portion 122 presenting the n-shape, and the second curved slideways 126*a* located at the same side takes the rotating axial direction A1 as an axial center. In other words, the two pairs of second curved slideways 126*a* are symmetrically located at two opposite sides of the rotating member 120. Regarding one pair of the second curved slideways 126*a*, the two second slideways 126*a* are both arcs that take the rotating axial direction A1 as the axial center. In other words, trajectories of the two second slideways 126*a* can be regarded as partial arcs of two concentric circles with different radii that take the rotating axial direction A1 as a circle center, and expanded angles of the two curved slideways 126*a* relative to the axial center are the same. Correspondingly, an outer side of the extension member 130 pivotally disposed in the second connection portion 122 has two pairs of second slide poles 132*a* and 132*b*, which are respectively located at two opposite sides of the extension member 130, and a connection direction D2 of the pair of the second slide poles 132*a* and 132*b* located at a same side passes through the rotating axial direction A1. In this way, the two pairs of the second slide poles 132*a* and 132*b* can be correspondingly embedded in the two pairs of second curved slideways 126*a*, wherein the second slide poles 132*a* and 132*b* can slide along the second curved slideways 126*a* correspondingly, such that the extension member 130 is adapted to rotate relative to the rotating member 120 along the rotating axial direction A1 while taking the rotating axial direction A1 as an axial center. Therefore, based on the design of the two pairs of second curved slideways 126*a* and the two pairs of second slide poles 132*a* and 132*b*, the extension member 130 can rotate relative to the rotating member 120 along the virtual rotating axial direction A1.

Figure 4A:
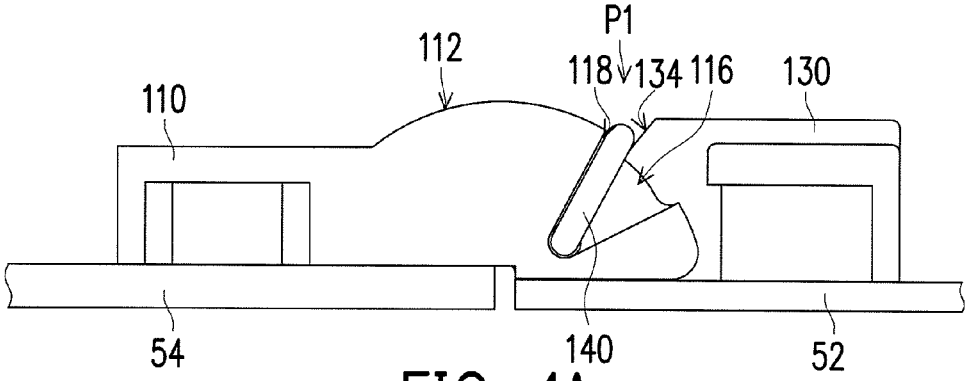
FIG. 4A to FIG. 4C are schematic diagrams illustrating actuations of the hinge structure of FIG. 1.
Figure 4B:
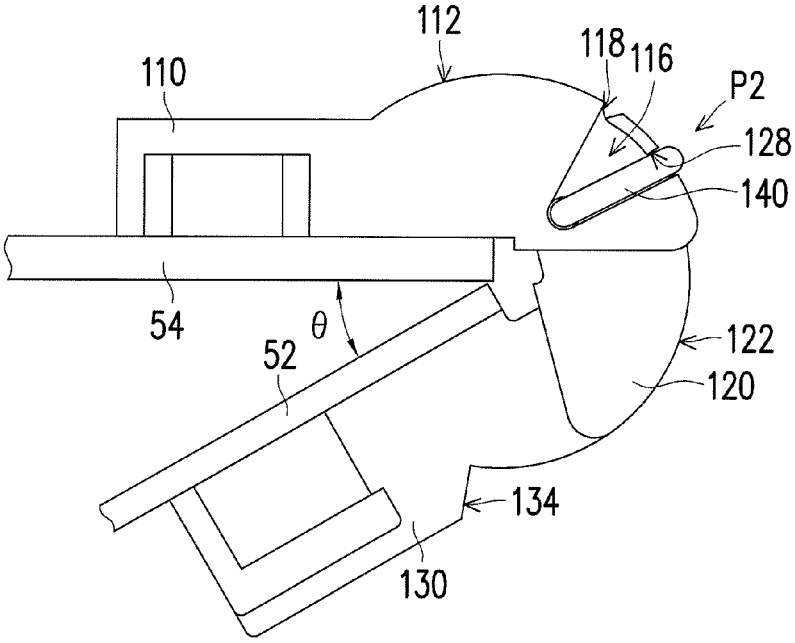
Figure 4C:
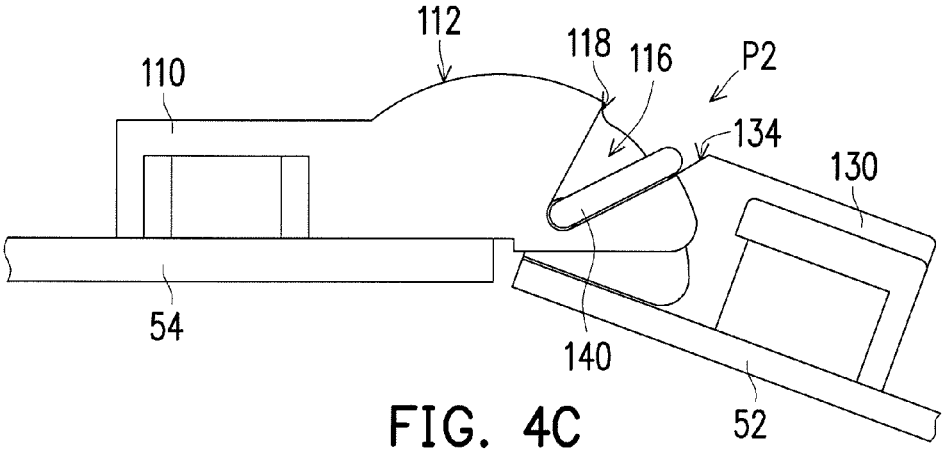

FIG. 4A to FIG. 4C are schematic diagrams illustrating actuations of the hinge structure of FIG. 1. Referring to FIG. 2A, FIG. 3 and FIG. 4A, in the present embodiment, when the fixing member 110, the rotating member 120 and the extension member 130 of the hinge structure 100 are not rotated relative to each other, the upper plate 52 and the lower plate 54 serving as the two parts construct a plane, as shown in FIG. 2A and FIG. 4A. Then, referring to FIG. 2B, FIG. 3 and FIG. 4B, after the rotating member 120 rotates relative to the fixing member 110 along the rotating axial direction A1 (which is perpendicular to a drawing plane of FIG. 4A) and the extension member 130 rotates relative to the rotating member 120 along the rotating axial direction A1, the included angle θ between the extension member 130 and the fixing member 110 presents an acute angle, so that the upper plate 52 and the lower plate 54 serving as the two parts are adapted to stand on the platform T. Now, the rotating member 120 and the extension member 130 rotate relative to the fixing member 110 to present the fan-shape expansion. Moreover, in the present embodiment, the fixing member 110 has a first recess 118, and the rotating member 120 has a second recess 128. When the clamping member 140 clamps the first connection portion 112, the second connection portion 122 and the extension member 130 from outside inward, the force-exerting portions 142*a* and 142*b* of the clamping member 140 are located in the positioning recesses 116, and the stop portion 144 is located in the first recess 118 and the second recess 128. In this way, when the rotating member 120 rotates relative to the fixing member 110, the rotating member 120 drives the clamping member 140 to move relative to the first recess 118 from a first position P1 to a second position P2 through a side edge of the second recess 128, and a process thereof is shown as FIG. 4A to FIG. 4B. In other words, during the process that the rotating member 120 rotates relative to the fixing member 110, before the side edge of the second recess 128 contacts the clamping member 140, the rotating member 120 can smoothly rotate relative to the fixing member 110. When the side edge of the second recess 128 of the rotating member 120 contacts the clamping member 140, the hinge structure 100 requires a larger external force to drive the rotating member 120 to continually rotate relative to the fixing member 110, i.e. the rotating member 120 requires a larger external force for driving the clamping member 140 to move relative to the first recess 118 from the first position P1 to the second position P2 through the side edge of the second recess 128. Therefore, the design of the second recess 128 and the clamping member 140 avails positioning of the hinge structure 100, so as to achieve a good operation feeling of the hinge structure 100.

Then, referring to FIG. 3 and FIG. 4C, when the electronic apparatus 50 receives an external force exerted towards the platform T, and the external force is transmitted to the hinge structure 100, the upper plate 52 and the lower plate 54, the extension member 130 and the fixing member 110 are adapted to increase the included angle θ therebetween through the external force exerted towards the platform T, until the included angle θ presents 180 degrees and the upper plate 52 and the lower plate 54 serving as the two parts reconstruct a plane. In detail, since the upper plate 52 and the lower plate 54 are pushed towards the platform T by the external force to gradually depart from each other, the extension member 130 and the fixing member 110 connected to the upper plate 52 and the lower plate 54 also gradually depart from each other to increase the included angle θ. The extension member 130 can rotate smoothly relative to the rotating member 120 to gradually move into the second connection portion 122 presenting the n-shape in the rotating member 120. Similarly, the rotating member 120 can also rotate smoothly relative to the fixing member to gradually move into the first connection portion 112 presenting the n-shape in the fixing member 110, and a process thereof is shown as FIG. 4B to FIG. 4C. Now, the second recess 128 previously pushing the clamping member 140 to the second position P2 moves into the first connection portion 112 along with the rotating member 120 and no longer limits the clamping member 140. Moreover, in the present embodiment, the extension member 130 further has a third recess 134. When the extension member 130 rotates relative to the rotating member 120 to move into the second connection member 122, the extension member 130 drives the clamping member 140 to move relative to the first recess 118 from the second position P2 to the first position P1 through a side edge of the third recess 134, and a process thereof is shown as FIG. 4C to FIG. 4A.

In detail, during the process that the extension member 130 rotates relative to the rotating member 120, before the side edge of the third recess 134 contacts the clamping member 140 located at the second position P2, the extension member 130 can smoothly rotate relative to the rotating member 120. When the side edge of the third recess 134 of the extension member 130 contacts the clamping member 140, the hinge structure 100 requires a larger external force to make the extension member 130 to drive the clamping member 140 to move relative to the first recess 118 from the second position P2 to the first position P1 through the side edge of the third recess 134. Therefore, the design of the third recess 134 and the clamping member 140 avails positioning of the hinge structure 100, so as to achieve a good operation feeling of the hinge structure 100. In the present embodiment, a rotation stroke of the clamping member 140 between the first position P1 and the second position P2 is about 20 degrees, though the invention is not limited thereto. Now, the included angle θ between the extension member 130 and the fixing member 110 presents 180 degrees, and the upper plate 52 and the lower plate 54 reconstruct a plane, and a process thereof is shown as FIG. 2B to FIG. 2A and FIG. 4B to FIG. 4C to FIG. 4A.

According to the above descriptions, in the present embodiment, the fixing member 110, the rotating member 120 and the extension member 130 of the hinge structure 100 can rotate relative to each other along the virtual rotating axial direction A1 to present the fan-shape expansion, and a method for implementing the rotations between the above members along the virtual rotating axial direction A1 is to adopt two pairs of curved slideways that take the rotating axial direction A1 as the axial center in collaboration with two pairs of slide poles with a connection direction thereof passing through the rotating axial direction A1. Moreover, positions of the aforementioned collaborated curved slideways and the slide poles can be exchanged. For example, the two pairs of first curved slideways 114*a* and 114*b* disposed on the fixing member 110 can be adjusted to the rotating member 120, and the two pairs of first slide poles 124*a* and 124*b* disposed on the rotating member 120 can be adjusted to the fixing member 110, and the first curved slideways 114*a* and 114*b* and the first slide poles 124*a* and 124*b* still match to each other to facilitate the rotating member 120 to rotate relative to the fixing member 110 along the rotating axial direction A1, though the invention is not limited to the above implementation, and the above implementation can be adjusted according to an actual requirement. Moreover, in the present embodiment, a rotation stroke of the rotating member 120 rotating relative to the fixing member 110 is 0 to 75 degrees, and a rotation stroke of the extension member 130 rotating relative to the rotating member 120 is 0 to 75 degrees. Therefore, when the fixing member 110, the rotating member 120 and the extension member 130 present the fan-shape expansion, the included angle θ between the extension member 130 and the fixing member 110 is between 30 degrees to 180 degrees. In this way, after the hinge structure 100 of the present embodiment connects two parts (for example, the upper plate 52 and the lower plate 54), the part (for example, the upper plate 52) connected to the extension member 130 is first flipped downwards to make the hinge structure 100 to present the fan-shape expansion until the included angle θ between the extension member 130 and the fixing member 110 presents an acute angle (for example, 30 degrees). Thereafter, in case that the hinge structure 100 sustains an external force, the included angle θ is gradually increased until 180 degrees to restore the original state, such that the hinge structure 100 is not damaged due to the external force. Moreover, the rotated hinge structure 100 can also be restored to its original state according to the aforementioned method. Namely, when the user does not want to use the upper plate 52 and the lower plate 54 connected to the hinge structure 100 to support the electronic apparatus 50, the user can exert an external force to the platform T, and the upper plate 52 and the lower plate 54 can expand relative to each other to drive the hinge structure 100 to restore its original state (the included angle θ presents 180 degrees). Therefore, the hinge structure 100 of the present embodiment has a good operation mode.

In summary, in the hinge structure of the invention, the rotating member is pivotally disposed on the fixing member, and the extension member is pivotally disposed on the rotating member, where after the rotating member rotates relative to the fixing member along the rotating axial direction and the extension member rotates relative to the rotating member along the rotating axial direction, the included angle between the extension member and the fixing member presents an acute angle. In other words, the rotating member and the extension member can present the fan-shape expansion relative to the fixing member. In this way, when the fixing member and the extension member are respectively fixed at the two parts, the two parts are adapted to rotate relative to each other through the hinge structure to stand on the platform. Thereafter, even if the extension member and the fixing member receive an external force, the included angle therebetween is only increased until presenting 180 degrees other than a situation that the included angle therebetween is reduced to spoil the connection relationship, so that the hinge structure is not damaged when taking the external force, and the rotated hinge structure can also be restored to its original state through the above method. Therefore, the hinge structure of the invention is adapted to connect two parts and presents a fan-shape expansion, so as to achieve a good operation mode.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A hinge structure, adapted to connect two parts, wherein the two parts are adapted to rotate relative to each other through the hinge structure, the hinge structure comprising:

a fixing member, adapted to be fixed at one of the two parts;

a rotating member, pivotally disposed on the fixing member; and an extension member, pivotally disposed on the rotating member, and adapted to be fixed at another one of the two parts, wherein after the rotating member rotates relative to the fixing member along a rotating axial direction and the extension member rotates relative to the rotating member along the rotating axial direction, an included angle between the extension member and the fixing member presents an acute angle, so that the two parts are adapted to stand on a platform, and the extension member and the fixing member are adapted to increase the included angle therebetween through an external force exerted towards the platform, until the included angle presents 180 degrees and the two parts construct a plane;

the fixing member has a first guide slot; the rotating member has a second guide slot and a first guide protrusion for sliding in the first guide slot during rotation of the rotating member relative to the fixing member; and the extension member has a second guide protrusion for sliding in the second guide slot during rotation of the extension member relative to the rotating member;

the fixing member has a first connection portion, the rotating member is pivotally disposed in the first connection portion, the rotating member has a second connection portion, and the extension member is pivotally disposed in the second connection portion, and the first connection portion, the second connection portion and the extension member are overlapped to each other;

a clamping member, clamping the first connection portion, the second connection portion and the extension member from outside inward, such that the fixing member, the rotating member and the extension member maintain fixed distances along a force-exerting axial direction of the clamping member;

wherein the force-exerting axial direction is parallel to the rotating axial direction, such that the fixing member, the rotating member and the extension member clamped by the clamping member produce frictions therebetween when rotating relative to each other.

2. The hinge structure as claimed in claim 1, wherein the clamping member comprises two force-exerting portions and a stop portion connected to the two force-exerting portions, the two force-exerting portions are opposite to each other for clamping the fixing member, the rotating member and the extension member from outside inward, and the stop portion is located above the fixing member, the rotating member and the extension member.

3. The hinge structure as claimed in claim 1, wherein the fixing member has a first recess, the rotating member has a second recess, the clamping member is located in the first recess and the second recess, and when the rotating member rotates relative to the fixing member, the rotating member drives the clamping member to move relative to the first recess from a first position to a second position through a side edge of the second recess.

4. The hinge structure as claimed in claim 3, wherein the extension member has a third recess, and when the extension member rotates relative to the rotating member, the extension member drives the clamping member to move relative to the first recess from the second position to the first position through a side edge of the third recess.

5. The hinge structure as claimed in claim 1, wherein the first guide slot has two pairs of first curved slideways respectively located at two opposite sides of the fixing member, and the pair of the first curved slideways located at a same side takes the rotating axial direction as an axial center, the first guide protrusion has two pairs of first slide poles respectively located at two opposite sides of the rotating member, and a connection direction of the pair of the first slide poles located at a same side passes through the rotating axial direction, and the two pairs of the first slide poles are correspondingly embedded in the two pairs of the first curved slideways, such that the rotating member is adapted to rotate relative to the fixing member along the rotating axial direction.

6. The hinge structure as claimed in claim 5, wherein the second guide slot has two pairs of second curved slideways respectively located at two opposite sides of the rotating member, and the pair of the second curved slideways located at a same side takes the rotating axial direction as an axial center, the second guide protrusion has two pairs of second slide poles respectively located at two opposite sides of the extension member, and a connection direction of the pair of the second slide poles located at a same side passes through the rotating axial direction, and the two pairs of the second slide poles are correspondingly embedded in the two pairs of the second curved slideways, such that the extension member is adapted to rotate relative to the rotating member along the rotating axial direction.

7. The hinge structure as claimed in claim 1, wherein a rotation stroke of the rotating member rotating relative to the fixing member is 0 to 75 degrees, and a rotation stroke of the extension member rotating relative to the rotating member is 0 to 75 degrees, such that the included angle between the extension member and the fixing member is between 30 degrees and 180 degrees.

* * * * *